US008755545B2

(12) United States Patent
Kates

(10) Patent No.: US 8,755,545 B2
(45) Date of Patent: Jun. 17, 2014

(54) STABILITY AND SPEECH AUDIBILITY IMPROVEMENTS IN HEARING DEVICES

(75) Inventor: James Mitchell Kates, Niwot, CO (US)

(73) Assignee: GN Resound A/S, Ballerup (DK)

( * ) Notice: Subject to any disclaimer, the term of this patent is extended or adjusted under 35 U.S.C. 154(b) by 399 days.

(21) Appl. No.: 13/286,089

(22) Filed: Oct. 31, 2011

(65) Prior Publication Data

US 2013/0089227 A1 Apr. 11, 2013

(30) Foreign Application Priority Data

Oct. 8, 2011 (EP) ..... 1118448

(51) Int. Cl.
*H04R 25/00* (2006.01)

(52) U.S. Cl.
USPC ..... 381/316; 381/312

(58) Field of Classification Search
USPC ..... 381/312, 316
See application file for complete search history.

(56) References Cited

U.S. PATENT DOCUMENTS

| | | | | |
|---|---|---|---|---|
| 4,856,068 | A | 8/1989 | Quatieri, Jr. et al. | |
| 4,885,790 | A | 12/1989 | McAulay et al. | |
| 5,054,072 | A | 10/1991 | McAulay et al. | |
| 5,274,711 | A | 12/1993 | Rutledge et al. | |
| 6,236,731 | B1 * | 5/2001 | Brennan et al. | 381/316 |
| 8,180,081 | B2 * | 5/2012 | Lunner | 381/316 |
| 8,571,243 | B2 * | 10/2013 | Komagel et al. | 381/316 |
| 2002/0176584 | A1 | 11/2002 | Kates | |
| 2011/0249845 | A1 | 10/2011 | Kates | |

FOREIGN PATENT DOCUMENTS

| | | |
|---|---|---|
| EP | 1 742 509 A1 | 1/2007 |
| EP | 2 309 777 A1 | 4/2011 |
| EP | 2 375 785 A2 | 10/2011 |

OTHER PUBLICATIONS

Thomas F. Quatieri et al., "An Approach to Co-Channel Talker Interference Suppression Using a Sinusoidal Model for Speech", Lincoln Laboratory, Lexington, Massachusetts, IEEE 1988, pp. 565-568.

James M. Kates, "Speech Enhancement Based on a Sinusoidal Model", Journal of Speech and Hearing Research, vol. 37, American Speech-Language Hearing Association, Apr. 1994, pp. 449-464.

Jesper Jensen et al., "Speech Enhancement Using a Constrained Iterative Sinusoidal Model", IEEE Transactions on Speech and Audio Processing, vol. 9, No. 7, Oct. 2001, pp. 731-740.

James M. Kates et al., "Coherence and the Speech Intelligibility Index" J. Acoust. Soc. Am., vol. 117, No. 4, Pt. 1, Apr. 2005, pp. 2224-2237.

James M. Kates et al., "The Hearing-Aid Speech Quality Index (HASQI)" J. Audio Eng. Soc., vol. 58, No. 5, May 2010, pp. 363-381.

(Continued)

*Primary Examiner* — Brian Ensey
(74) *Attorney, Agent, or Firm* — Vista IP Law Group, LLP

(57) ABSTRACT

A hearing device includes a first filter configured for providing a first frequency part of an input signal of the hearing device, the first frequency part comprising a low pass filtered part, a second filter configured for providing a second frequency part of the input signal, the second frequency part comprising a high pass filtered part, a first synthesizing unit configured for generating a first synthetic signal from the first frequency part using a first model based on a first periodic function, and a combiner configured for combining the second frequency part with the first synthetic signal for provision of a combined signal.

23 Claims, 11 Drawing Sheets

(56) References Cited

OTHER PUBLICATIONS

European Search Report mailed Mar. 16, 2012, for EP Application No. 11184448.6.
Blamey, P J et al., "Formant-based processing for hearing aids", Speech Communication, Elsevier Science Publishers, Amsterdam, NL vol. 13, Nos. 3/4, Dec. 1993, 9 pages.
Levine, Scott N. et al., "Multiresolution sinusoidal modeling for wideband audio with modifications", Proceedings of the IEEE, 1998, pp. 3585-3588.
Flanagan, J.L. et al., "Computer studies on parametric coding of speech spectra", J. Acoust. Soc. Am., vol. 68(2), Aug. 1980, pp. 420-430.
Aguilera, C.M. et al., "Enhancement of spectral contrast to speech using a sinusoidal model", Electronics Letters, vol. 35, No. 23, Nov. 11, 1999, 2 pages.
McAulay, Robert J., et al., "Speech Analysis/Synthesis Based on a Sinusoidal Representation", IEEE Transactions on Acoustics, Speech, and Signal Processing, vol. ASSP-34, No. 4, Aug. 1986, 11 pages.

* cited by examiner

STABILITY AND SPEECH AUDIBILITY IMPROVEMENTS IN HEARING DEVICES

RELATED APPLICATION DATA

This application claims priority to and the benefit of European Patent Application No. 11184448.6, filed on Oct. 8, 2011, the entire disclosure of which is expressly incorporated by reference herein.

FIELD

The present application pertains to signal de-correlation for stability improvements in hearing devices such as hearing aids and to improve speech audibility in such.

BACKGROUND

Signal processing in hearing aids is usually implemented by determining a time-varying gain for a signal, and then multiplying the signal within by the gain. This approach gives a linear time-varying system, that is, a filter with a frequency response that changes over time. This system can be very effective for those types of processing, such as dynamic-range compression and noise suppression, where the desired signal processing is a time- and frequency-dependent gain. But because of its linear nature, a time-varying filter cannot be used to implement nonlinear processing such as frequency shifting or phase randomization as disclosed by Applicant in the subject application.

An alternative approach is to use an analysis/synthesis system. For the analysis the incoming signal is usually divided into segments, and each segment is analyzed to determine a set of signal properties. For the synthesis, a new signal is generated using the measured or modified signal properties. An effective analysis/synthesis procedure is sinusoidal modeling known from U.S. Pat. No. 4,885,790, U.S. RE 36,478 and U.S. Pat. No. 4,856,068. In sinusoidal modeling the speech is divided into overlapping segments. The analysis consists of computing a fast Fourier transform (FFT) for each segment, and then determining the frequency, amplitude, and phase of each peak of the FFT. For the synthesis, a set of sinusoids is generated. Each sinusoid is matched to a peak of the FFT; not all peaks are necessarily used. Rules are provided to link the amplitude, phase, and frequency of a peak in one segment to the corresponding peak in the next segment, and the amplitude, phase, and frequency of each sinusoid is interpolated across the output segments to give a smoothly varying signal. The speech is thus reproduced using a limited number of modulated sinusoidal components.

Sinusoidal modeling provides a framework for nonlinear signal modifications. The approach can be used, for example, for digital speech coding as shown in U.S. Pat. No. 5,054,072. The amplitudes and phases of the signal are determined for the speech, digitally encoded, and then transmitted to the receiver where they are used to synthesize sinusoids to produce the output signal.

Sinusoidal modeling is also effective for signal time-scale and frequency modifications as reported in McAulay, R. J., and Quatieri, T. F. (1986), "Speech analysis/synthesis based on a sinusoidal representation", IEEE Trans. Acoust. Speech and Signal Processing, Vol ASSP-34, pp 744-754. For time-scale modification, the frequencies of the FFT peaks are preserved, but the spacing between successive segments of the output signal can be reduced to speed up the signal or increased to slow it down. For frequency shifting the spacing of the output signal segments is preserved along with the amplitude information for each sinusoid, but the sinusoids are generated at frequencies that have been shifted relative to the original values. Another signal manipulation is to reduce the peak-to-average ratio by dynamically adjusting the phases of the synthesized sinusoids to reduce the signal peak amplitude as shown in U.S. Pat. No. 4,885,790 and U.S. Pat. No. 5,054,072.

Sinusoidal modeling can also be used for speech enhancement. In Quatieri, T. F, and Danisewicz, R. G. (1990), "An approach to co-channel talker interference suppression using a sinusoidal model for speech", IEEE Trans Acoust Speech and Sginal Processing, Vol 38, pp 56-69 sinusoidal modeling is used to suppress an interfering voice, and Kates (reported in Kates, J. M. (1994), "Speech enhancement based on a sinusoidal model", J. Speech Hear Res, Vol. 37, pp 449-464) has also used sinusoidal modeling as a basis for noise suppression. In the above mentioned Kates study, the high-intensity sinusoidal components of the signal assumed to be speech were reproduced but low-intensity components assumed to be noise were removed; however, no benefit in improving speech intelligibility was found. Jensen and Hansen (reported in Jensen, J., and Hansen, J. H. L. (2001), "Speech enhancement using a constrained iterative sinusoidal model", IEEE Trans Speech and Audio Proc, Vol 9, pp 731-740) used sinusoidal modeling to enhance speech degraded by additive broadband noise, and found their approach to be more effective than the comparison schemes such as Wiener filtering.

Sinusoidal modeling has also been applied to hearing loss and hearing aids. Rutledge and Clements (reported in U.S. Pat. No. 5,274,711) used sinusoidal modeling as the processing framework for dynamic-range compression. They reproduced the entire signal bandwidth using sinusoidal modeling, but increased the amplitudes of the synthesized components at those frequencies where hearing loss was observed. A similar approach has been used by others to provide frequency lowering for hearing-impaired listeners by shifting the frequencies of the synthesized sinusoidal components lower relative to those of the original signal. The amount of shift was frequency-dependent, with low frequencies receiving a small amount of shift and higher frequencies receiving an increasingly larger shift.

SUMMARY

It is thus an object to provide a computationally simple way of providing stability improvements in a hearing device such as a hearing aid.

According to some embodiments, the above-mentioned and other objects are fulfilled by a first aspect pertaining to a hearing device comprising a first filter, a second filter, a first synthesizing unit, and a combiner. The first filter is configured for providing a first frequency part of an input signal of the hearing device. The first frequency part comprises or is a low pass filtered part, i.e. a low pass filtered part of the input signal. The second filter is configured for providing a second frequency part of the input signal. The second frequency part comprises or is a high pass filtered part, i.e. a high pass filtered part of the input signal. The first synthesizing unit is configured for generating a first synthetic signal from the first frequency part by using a first model based on a first periodic function. The combiner is configured for combining the second frequency part with the first synthetic signal for provision of a combined signal.

A second aspect pertains to a method of de-correlating an input signal and output signal of a hearing device. The method comprises selecting a plurality of frequency parts of the input signal, generating a first synthetic signal, and combining a plurality of process signals. The plurality of frequency parts includes a first frequency part and a second frequency part. The first frequency part comprises or is a low pass filtered part, i.e. a low pass filtered part of the input signal. The second frequency part comprises or is a high pass filtered part, i.e. a high pass filtered part of the input signal. The first synthetic signal is generated on the basis of at least the first frequency part and a first model. The first model is based on a first periodic function. The plurality of process signals, which are combined, includes the first synthetic signal and the second frequency part.

By creating the first synthetic signal from the first frequency part of the input signal and combining this synthetic signal with the second frequency part of the input signal it is achieved that the first frequency part of the input signal is at least in part de-correlated with the combined signal, thus leading to increased stability of the hearing device. By provision of the first and second frequency parts of the input signal by means of the first and second filters, respectively, and generating the synthetic signal only at one (or more) selected frequency part(s) significantly reduces the computational burden compared to generating a synthetic signal for a larger frequency range such as the entire frequency range of the hearing device. Thus, for one or more embodiments, a synthetic signal is generated from the first frequency part and not from the second frequency part. The resultant hearing device thus has the benefits of high stability combined with a greatly reduced computational burden.

Thus, it can be achieved that one (or more) synthetic signal(s) only or mainly are generated for frequencies where it is needed or where it is needed the most.

The hearing device according to some embodiments may be any one or any combination of the following: hearing instrument and hearing aid.

It is clear that for instance any band pass filtered part of a given signal implicitly comprises a low pass filtered part of that signal. Furthermore, it is also implicitly given that the band pass filtered part implicitly is a low pass filtered part, i.e. it is a low and a high pass filter part of the given signal.

The hearing device may comprise an input transducer, and/or a hearing loss processor and/or a receiver. The input transducer may be configured for provision of the input signal, such as provision of an electrical input signal. The hearing loss processor may be configured for processing the combined signal for provision of a processed signal. The hearing loss processor may, however, be configured for providing the processed signal by processing the second frequency part and the synthetic signal individually before combining the respective processed results by means of the combiner. The processing of the hearing loss processor may be in accordance with a hearing loss of a user of the hearing device. The receiver may be configured for converting the processed signal into an output sound signal.

The first filter may be connected to the input transducer. The second filter may be connected to the input transducer. The synthesizing unit may be connected to the output of the first filter. The combiner may be connected to the output of the second filter and connected to the output of the synthesizing unit. When using the phrase "connected to" in the present description it is clear that a first element (such as the first filter) may be considered to be connected to a second element (such as the input transducer) even if there is one or more third elements (such as amplifier(s), converter(s), etc.) connected there between.

The hearing device may comprise a third filter configured for providing a third frequency part of the input signal. The third frequency part may comprise or may be a low pass filtered part. The hearing device and/or the combiner may be configured for including the third frequency part in the combined signal.

The plurality of frequency parts may include a third frequency part comprising or being a low pass filtered part. The plurality of process signals may include the third frequency part.

The hearing device may comprise a fourth filter configured for providing a fourth frequency part of the input signal. The fourth frequency part may comprise or may be a high pass filtered part. The hearing device may comprise a second synthesizing unit configured for generating a second synthetic signal from the fourth frequency part using a second model based on a second periodic function. The hearing device and/or the combiner may be configured for including the second synthetic signal in the combined signal.

The plurality of frequency parts may include a fourth frequency part that may comprise or be a high pass filtered part. The method may comprise generating a second synthetic signal on the basis of the fourth frequency part and a second model, wherein the second model may be based on a second periodic function. The plurality of process signals may include the second synthetic signal.

The second frequency part may be a band pass filtered part, i.e. the second frequency part may be a band pass filtered part of the input signal.

The second frequency part may represent/comprise higher frequencies/a higher frequency range than the first frequency part.

The first frequency part may be a band pass filtered part, i.e. the first frequency part may be a band pass filtered part of the input signal.

The first filter may comprise or may be any one or any combination of the following: a low pass filter, a band pass filter, and a band stop filter.

The second filter may comprise or may be any one or any combination of the following: a high pass filter, a band pass filter, and a band stop filter.

The third filter may comprise or may be any one or any combination of the following: a low pass filter, a high pass filter, a band pass filter, and a band stop filter.

The fourth filter may comprise or may be any one or any combination of the following: a low pass filter, a high pass filter, a band pass filter, and a band stop filter.

The hearing device according to some embodiments may comprise a filter and a synthesizing unit for a plurality of instabilities, such as for two, three, four, or more instabilities.

The filters of the hearing device may be configured such that the input signal may be at least substantially divided into the plurality of frequency parts. This may be possible by providing that the filters have pairwise cutoff frequency/frequencies that is/are at least substantially the same and by providing that the number of such pairwise at least substantially identical cutoff frequency/frequencies is/are equal to the number of filters minus one. For instance, the first and second filters may be a complimentary pair of low and high pass filters, respectively, having the same or substantially the same cutoff (or crossover) frequency, i.e. one pairwise substantially identical cutoff frequency is provided. In one or more embodiments, the first filter may be a band pass filter, the second filter may be a high pass filter, and the third filter may be a low pass filter, where the cutoff frequency of the third filter is at least substantially identical to the lower cutoff frequency of the first filter and the cutoff frequency of the second filter is at least substantially identical to the higher cutoff frequency of the first filter, i.e. two pairwise substantially identical cutoff frequencies are proviced.

A first cutoff frequency of the first filter may be within approximately 200 Hz of a first cutoff frequency of the second filter, such as within 100 Hz, such as within 50 Hz.

According to one or more embodiments the first and/or second periodic function may be or may include a first/second trigonometric function, such as a first/second sinusoid or a linear combination of sinusoids. Hereby may be achieved a simple way of modelling speech, because speech signals may comprise a high degree of periodicity, and may therefore according to Fourier's theorem be modelled (or approximated) by a sinusoid, or a linear combination of sinusoids. This way a very accurate and yet computationally simple model of particularly speech signals, may be facilitated. It is understood that the term sinusoid may refer to a sine or a cosine.

The method may comprise shifting the frequency of the first synthetic signal and/or the frequency of the second synthetic signal. It is understood that any signal (such as the first synthetic signal and/or the second synthetic signal) of the hearing device according to some embodiments may comprise a plurality of frequencies such as at least substantially a continuum of frequencies within a given frequency range. Thus, it is clear that when referring to shifting the frequency of a given signal of a hearing device it may refer to shifting the frequencies of the mentioned signal or at least shifting some of the frequencies of the mentioned signal. The first synthesizing unit may be configured for shifting the frequency of the first synthetic signal. The second synthesizing unit may be configured for shifting the frequency of the second synthetic signal. By shifting the frequency a simple way of increasing the de-correlation between the input and output signals of the hearing device may be achieved.

The method may comprise and/or the first synthesizing unit may be configured for shifting the frequency of at least a first part of the first synthetic signal downward in frequency. Alternatively, or additionally, the method may comprise and/or the first synthesizing unit may be configured for shifting the frequency of at least a second part of the first synthetic signal upward in frequency.

The method may comprise and/or the second synthesizing unit may be configured for shifting the frequency of at least a first part of the second synthetic signal downward in frequency. Alternatively, or additionally, the method may comprise and/or the second synthesizing unit may be configured for shifting the frequency of at least a second part of the second synthetic signal upward in frequency.

Alternatively or additionally, the phase of the first synthetic signal (and/or any further synthetic signal, such as a/the second synthetic signal) may at least in part be randomized. This could for example be achieved by replacing the phase of the original (high frequency) signal by a random phase. Hereby an alternative way of providing de-correlation of the input and output signals may be achieved that is computationally simple.

In one or more embodiments, the frequency shifting of the synthetic signal may be combined with randomization of the phase. Thus, providing the benefits of de-correlation achieved by frequency shifting and de-correlation provided by phase randomization, simultaneously. Especially, this may lead to higher degree of de-correlation and thereby even further increased stability of the hearing device.

The randomization of the phase(s) may be adjustable. This could for example be achieved by blending any desired proportion of the original and random phases. Thus one can introduce the minimal amount of phase randomization needed to produce the desired system (hearing device) stability, and at the same time giving the highest possible speech quality for the desired degree of stability improvement, while keeping the computational burden as low as possible.

The hearing device according to some embodiments may comprise a feedback suppression filter, e.g. such as placed in a configuration as shown in US 2002/0176584. Hereby may be achieved an increased stability of the hearing device, thus enabling the use of a higher amplification in the hearing device before an onset of feedback.

Sinusoidal modelling of a signal may introduce distortion of the signal. Distortion, such as distortion introduced by sinusoidal modelling, may, however, be increasingly hard to hear for a user for increasing frequencies.

At least some feedback in a hearing device may be a high frequency phenomenon. However, some feedback in a hearing device may additionally or alternatively occur at any other frequency part.

In the present context, the denotation of high frequencies, mid frequencies, and low frequencies may be in relation to the frequency range of a normal hearing of a human, e.g. such as around 20 Hz to 20 kHz. Thus, the mention of high frequencies may in one or more embodiments refer to frequencies above 2 kHz, such as above 2.5 kHz, such as above 3 kHz, such as above 3.5 kHz. In this one or more embodiments, the mention of mid frequencies may refer to frequencies between 500 Hz and 2 kHz. The mention of low frequencies may in this one or more embodiment refer to frequencies below 500 Hz. In an alternative embodiment, the mention of high frequencies may refer to frequencies above 3 kHz, such as above 3.5 kHz. In this alternative embodiment, the mention of mid frequencies may refer to frequencies between 1500 Hz and 3 kHz. The mention of low frequencies may in this embodiment refer to frequencies below 1500 Hz. In yet another embodiment, the mention of high frequencies may in an embodiment refer to frequencies above 1.5 kHz, such as above 2 kHz, such as above 3 kHz, such as above 3.5 kHz. In this other embodiment, the mention of mid frequencies may refer to frequencies between 700 Hz and 1.5 kHz. The mention of low frequencies may in this embodiment refer to frequencies below 700 Hz.

The predominant form of hearing loss for a user of a hearing aid may be a high-frequency loss. Thus, lowering of the higher frequencies may improve at least the high-frequency audibility for these listeners.

Hearing losses exist where there is a loss of audibility at low frequencies e.g. with nearly-normal hearing at higher frequencies. By shifting the low frequencies higher and e.g. furthermore amplifying the signal, the audibility for a user having this type of loss may be improved.

Furthermore, a so-called "cookie-bite"-loss exist, which is a loss at the mid frequencies with better hearing at low and high frequencies. A system configured for providing a first, second and third frequency part could be of benefit here. For instance a low pass and a high pass filter may provide frequency parts where the signal is unmodified, and a mid-frequency band pass filter may provide a frequency part where sinusoidal modeling is applied to shift the mid frequencies to regions of greater audibility, e.g. by lowering and/or highering (i.e. increase of frequency of) the mid frequencies.

In the case of a mid-frequency loss, whether the frequencies are shifted up and/or down may depend on the exact frequency region that contains the loss. Shifting up may make the distortion less audible, but a user may have poorer frequency resolution at high frequencies so some frequency resolution may be lost as well.

Thus, an option for a mid-frequency loss would be to divide the loss region itself into two frequency regions, and to shift the lower of these two regions down in frequency and the higher of the two regions higher in frequency. This approach could thus result in an embodiment comprising four filter outputs: a lowpass that is not shifted in frequency, a lower bandpass that is shifted down in frequency, a higher bandpass that is shifted up in frequency, and a highpass that is not shifted in frequency.

For both the low-frequency and cookie-bite losses, audible distortion could be a problem since the processing distortion may be more noticeable at lower frequencies.

Shifting the frequencies of the high frequencies may improve the stability of a hearing aid, e.g. in order to reduce acoustic feedback.

Randomizing the phase of a signal may be an advantage for reducing acoustic feedback.

Frequency shifting may be an advantage for improving audibility.

Acoustic feedback at low frequencies could be a problem in e.g. a power device.

Phase randomization may be applied only in those one or more frequency region(s) where the hearing-aid instability is highest. Alternatively, or additionally, Sinusoidal modelling may be used for the entire input signal.

If a loss of audibility is in the low frequency, the frequencies may be shifted upwards. If a loss of audibility is in the mid frequencies, the frequencies may be shifted upwards (even thought they could in this case also be shifted downwards), because the distortion that may be introduced by the modelling may be harder to hear as the frequency increases.

The method may comprise and/or the first synthesizing unit may be configured for

- dividing the first frequency part into a first plurality of segments, which segments may be overlapping, and/or
- windowing and transforming each segment of the first plurality of segments into the frequency domain, and/or
- selecting the N highest peaks in each segment, where N is at least 2,
- wherein generating the first synthetic signal may include replacing each or some of the selected peaks with the first periodic function.

Additionally, or alternatively, the method may comprise and/or the second synthesizing unit may be configured for

- dividing the second frequency part into a second plurality of segments, which segments may be overlapping, and/or
- windowing and transforming each segment of the second plurality of segments into the frequency domain, and/or
- selecting the N highest peaks in each segment, where N is at least 2,
- wherein generating the second synthetic signal may include replacing each or some of the selected peaks with the second periodic function.

The segments may be overlapping, e.g. so that signal feature loss by the windowing may be accounted for.

Generating the first synthetic signal and/or the second synthetic signal may comprise using the frequency, amplitude and phase of each of the N peaks.

At least a first part of the generated first and/or second synthetic signal may be shifted downward in frequency by replacing at least a first part of the respective selected peaks with a periodic function having a lower frequency than the frequency of the at least first part of the respective selected peaks.

At least a second part of the generated first and/or second synthetic signal may be shifted upward in frequency by replacing at least a second part of the respective selected peaks with a periodic function having a higher frequency than the frequency of the at least second part of the respective selected peaks.

The phase of the first synthetic signal and/or the second synthetic signal may at least in part be randomized, by replacing at least some of the phases of some of the selected peaks with a phase randomly or pseudo randomly chosen from a uniform distribution over $(0, 2\pi)$ radians.

The randomization of the phase(s) may, furthermore or alternatively, be performed in dependence of the stability or stability requirements of the hearing device.

In accordance with some embodiments, a hearing device includes a first filter configured for providing a first frequency part of an input signal of the hearing device, the first frequency part comprising a low pass filtered part, a second filter configured for providing a second frequency part of the input signal, the second frequency part comprising a high pass filtered part, a first synthesizing unit configured for generating a first synthetic signal from the first frequency part using a first model based on a first periodic function, and a combiner configured for combining the second frequency part with the first synthetic signal for provision of a combined signal.

In accordance with other embodiments, a method of decorrelating an input signal and an output signal of a hearing device includes selecting a plurality of frequency parts of the input signal, the plurality of frequency parts including a first frequency part and a second frequency part, the first frequency part comprising a low pass filtered part, the second frequency part comprising a high pass filtered part, generating a first synthetic signal based on the first frequency part and a first model, the first model being based on a first periodic function, and

- combining a plurality of process signals, the plurality of process signals including the first synthetic signal and the second frequency part.

While several embodiments of several aspects have been described above, it is to be understood that any feature from one or more embodiments of one of the aspects may be comprised in one or more embodiments of one or several of the other aspects, and when it in the present patent specification is referred to "an embodiment" or "one or more embodiments" it is understood that it can be one or more embodiments according to any one of the aspects.

BRIEF DESCRIPTION OF THE DRAWINGS

In the following, embodiments are explained in more detail with reference to the drawing, wherein FIG. 1 schematically illustrates an embodiment of a hearing aid, FIG. 2 schematically illustrates an alternative embodiment of a hearing aid, FIG. 3 schematically illustrates an another embodiment of a hearing aid, FIG. 4 schematically illustrates an yet another embodiment of a hearing aid, FIG. 5 schematically illustrates yet another alternative embodiment of a hearing aid, FIG. 6 schematically illustrates a magnitude spectrum of a windowed speech segment, FIG. 7 schematically illustrates an example of frequency lowering, FIG. 8 schematically illustrates a spectrogram of a test signal comprising two sentences, the first spoken by a female talker and the second spoken by a male talker, FIG. 9 schematically illustrates the spectrogram for the test sentences reproduced using sinusoidal modeling for the entire spectrum, FIG. 10 schematically illustrates the spectrogram for the test sentences reproduced applying sinusoidal modeling above 2 kHz, FIG. 11 schematically illustrates the spectrogram for the test sentences reproduced applying sinusoidal modeling with 2:1 frequency compression above 2 kHz, FIG. 12 schematically illustrates the spectrogram for the test sentences reproduced applying sinusoidal modeling with random phase above 2 kHz, FIG. 13 schematically illustrates the spectrogram for the test sentences reproduced applying sinusoidal modeling with 2:1 frequency compression and random phase above 2 kHz.

DETAIL DESCRIPTION

Figure 1:
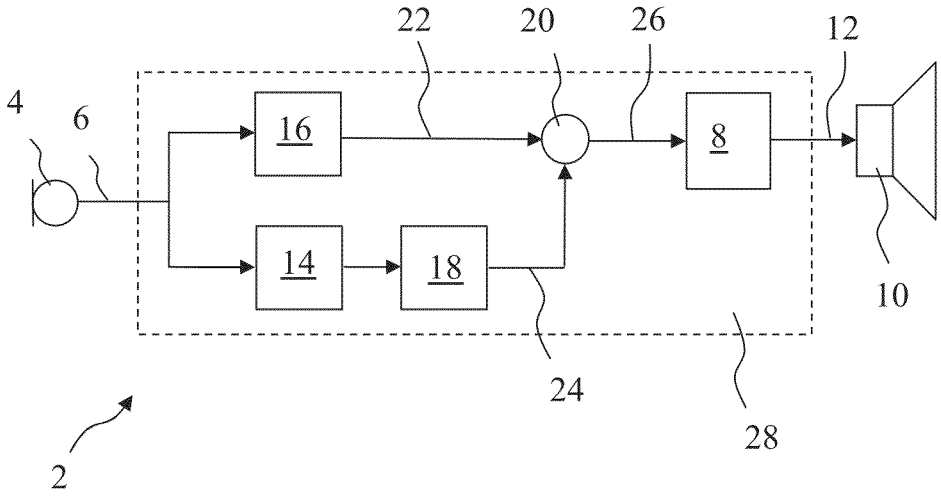

Various embodiments are described hereinafter with reference to the figures. The claimed invention may, however, be embodied in different forms and should not be construed as limited to the embodiments set forth herein. It should be noted that the figures are not drawn to scale and that elements of similar structures or functions are represented by like reference numerals throughout the figures. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated. Also, reference throughout this specification to "some embodiments" or "other embodiments" means that a particular feature, structure, material, or characteristic described in connection with the embodiments is included in at least one embodiment. Thus, the appearances of the phrase "in some embodiments" or "in other embodiments" in various places throughout this specification are not necessarily referring to the same embodiment or embodiments.

FIG. 1 illustrates an embodiment of a hearing aid 2 according to some embodiments. The illustrated hearing aid 2 comprises an input transducer, which here is embodied as a microphone 4 for the provision of an electrical input signal 6. The hearing aid 2 also comprises a hearing loss processor 8 configured for processing the electrical input signal 6 (or a signal derived from the electrical input signal 6) in accordance with a hearing loss of a user of the hearing aid 2. It is understood that the electrical input signal 6 is an audio signal. The illustrated hearing aid 2 also comprises a receiver 10 for converting a processed signal 12 into an output sound signal. In the illustrated embodiment, the processed signal 12 is the output signal of the hearing loss processor 8. The hearing loss processor 8 according to some embodiments, such as illustrated in any of FIG. 1-5 or 19-23, may comprise a so called compressor that is adapted to process an input signal to the hearing loss processor 8 according to a frequency and/or sound pressure level dependent a hearing loss compensation algorithm. Furthermore, the hearing loss processor 8 may alternative or additionally be configured to run other standard hearing aid algorithms, such as noise reduction algorithms.

The hearing aid 2 furthermore comprises a first filter 14 and a second filter 16. The filters 14 and 16 are connected to the input transducer (the microphone 4).

The first filter 14 is configured for providing a first frequency part of the input signal 6 of the hearing aid 2. The first frequency part comprises a low pass filtered part. The second filter 16 is configured for providing a second frequency part of the input signal 6. The second frequency part comprises a high pass filtered part. Thus, a plurality of frequency parts are provided from the input signal 6. The filters, 14 and 16, may be designed as a complementary pair of filters. The filters 14 and 16 may be or may comprise five-pole Butterworth high-pass and low-pass designs having at least substantially the same cutoff frequency, and which may be transformed into digital infinite impulse response (IIR) filters using a bilinear transformation. The cutoff frequency may be chosen to be 2 kHz, wherein the synthetic signal 24 based partly on the input signal 6 is only generated in the frequency region below 2 kHz. In yet another embodiment the cutoff frequency is adjustable, for example in the range from 1.5 kHz to 2.5 kHz.

The illustrated hearing aid 2 also comprises a first synthesizing unit 18 connected to the output of the first filter 14. The first synthesizing unit 18 is configured for generating a first synthetic signal 24 based on the first frequency part (i.e. the output signal of the first filter 14) and a first model. The model is based on a first periodic function. Hereby is provided a simple way of providing an audio signal within the first frequency part, which to at least a certain degree is de-correlated with the input signal 6.

A combiner 20 (in this embodiment illustrated as a simple adder) is connected to the output of the second filter 16 and the output of the first synthesizing unit 18 for combining the second frequency part with the first synthetic signal 24 for provision of a combined signal 26. The combined signal 26 is then processed in the hearing loss processor 8, by for example using standard hearing-aid processing algorithms such as dynamic-range compression and possibly also noise suppression.

The first and second filters 14 and 16, respectively, first synthesizing unit 18, combiner 20 and hearing loss processor 8 may be implemented in a Digital Signal Processing (DSP) unit 28, which could be a fixed point DSP or a floating point DSP, depending on the requirement and battery power available. Thus, it is understood that according to one or more embodiments, the hearing aid 2 may comprise an A/D converter (not shown) for transforming the microphone signal into a digital signal 6 and a D/A converter (not shown) for transforming the processed signal 12 into an analogue signal.

The periodic function on which the model is based may be a trigonometric function, such as a sinusoid or a linear combination of sinusoids. For simplicity of description only sinusoidal modelling (for example according to the procedure disclosed in McAulay, R. J., and Quatieri, T. F. (1986), "Speech analysis/synthesis based on a sinusoidal representation", IEEE Trans. Acoust. Speech and Signal Processing, Vol ASSP-34, pp 744-754) will be mentioned as a primary example in the following description of embodiments, but with regard to every example mentioned in the present patent specification, it should be noted that any other modelling based on a periodic function may be used instead.

Figure 2:
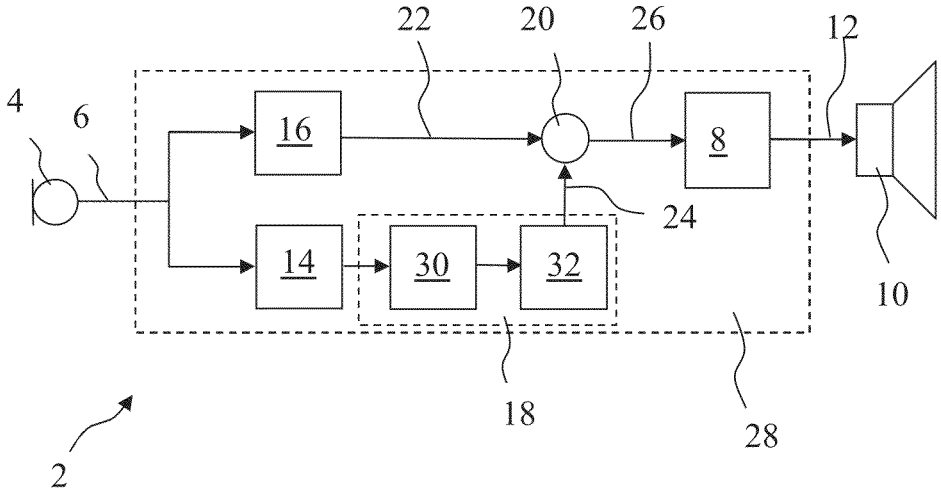

FIG. 2 illustrates another embodiment of a hearing aid 2. Since the embodiment illustrated in FIG. 2 is very similar to the embodiment illustrated in FIG. 1, only the differences will be described. In the illustrated embodiment (FIG. 2) the first synthesizing unit 18 is shown divided into two signal processing blocks 30, and 32. The in the first block 30 frequency shifting is performed. The frequency shift (e.g. lowering and/or highering and/or warping) is implemented by using the measured amplitude and phase of the output signal of the first filter 14, and generating an output sinusoid at a shifted frequency. The sinusoid generation is performed in the block 32. The amplitude for the sinusoid is still used, thus preserving the envelope behavior of the original signal. Sinusoidal modeling together with frequency shifting will enhance the de-correlation of the input and output signals of the hearing aid 2, and will thus lead to increased stability.

Figure 3:
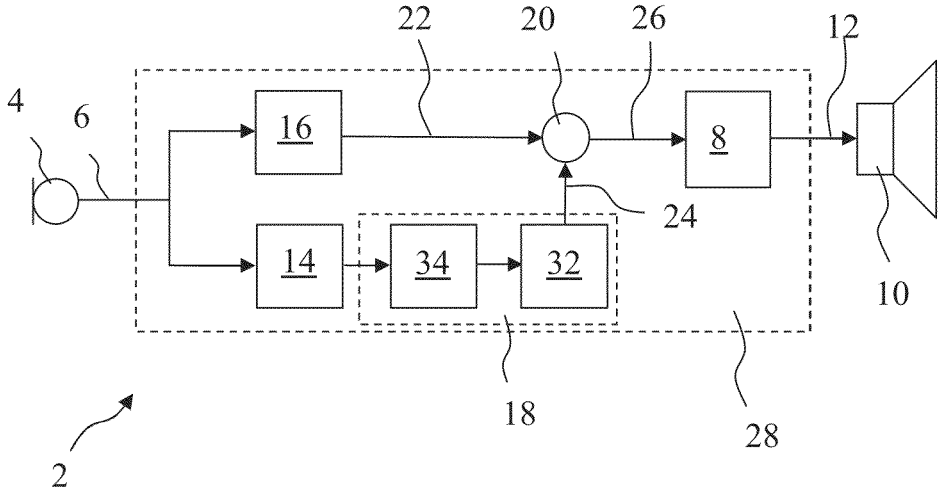

FIG. 3 illustrates an alternative or additional way of enhancing the de-correlation between the input and output signals of the hearing aid 2 shown in FIG. 2. Instead of (or in addition to) frequency shifting, the phase of the incoming signal to the first synthesizing unit 18 is randomized, as indicated by the processing block 34. The random phase may be implemented by replacing the measured phase for the incoming signal (i.e. the output signal of the first filter 14) by a random phase value chosen from a uniform distribution over $(0, 2\pi)$ radians. Also here the amplitude for the sinusoid is still used, thus preserving the envelope behavior of the signal.

Figure 4:
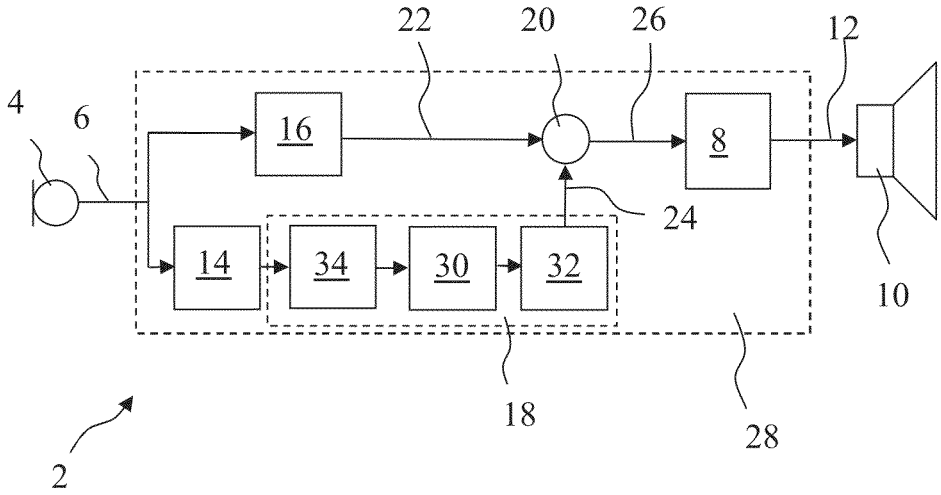

FIG. 4 illustrates an embodiment of a hearing aid 2, wherein frequency shifting and phase randomization is combined with sinusoidal modeling, as illustrated by the processing blocks 30 and 34. For the combined processing, the sinusoidal modeling performed in the first synthesizing unit 18 uses the original amplitude and random phase values of the input signal to the first synthesizing unit 18, and then generates the output sinusoids at shifted frequencies. The combination of frequency shifting and phase randomization may be implemented using the two-band system with sinusoidal modeling below 2 kHz. The frequencies below 2 kHz may in one or more embodiments be reproduced using ten sinusoids. Hereby is achieved a very simple way of obtaining a very high degree of de-correlation between the input and output signals of the hearing aid 2.

Figure 5:
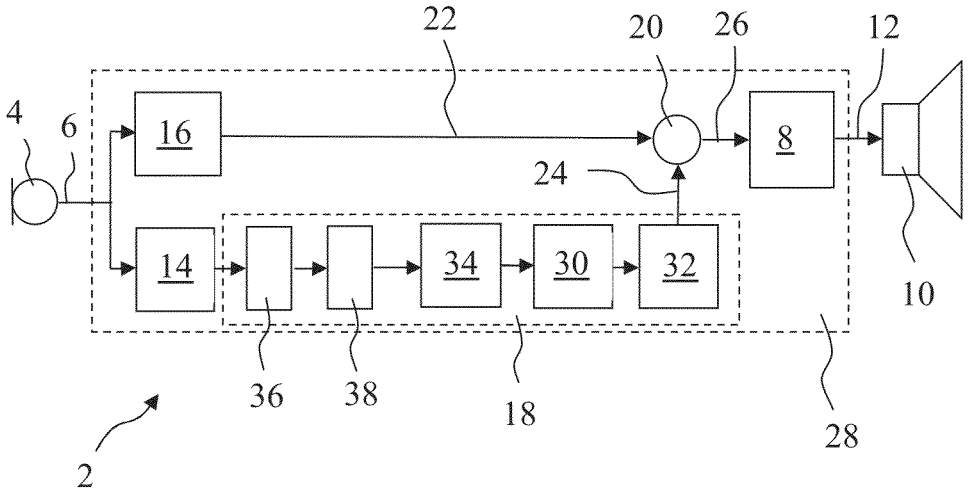

FIG. 5 illustrates another embodiment of a hearing aid 2 according to some embodiments, wherein frequency shifting and phase randomization is combined with sinusoidal modeling. The incoming signal to the first synthesizing unit 18 is the output signal from the first filter 14. This incoming signal is divided into segments as illustrated by the processing block 36. The segments may be overlapping, e.g. in order to account for loss of features during windowing. Each segment may be windowed in order to reduce spectral leakage and an FFT is computed for the segment, as illustrated by the processing block 38. The N highest peaks of the magnitude spectrum may be selected, and the frequency, amplitude, and phase of each peak may be saved in a data storage unit (not shown explicitly) within the hearing aid 2. The output signal may then be synthesized by generating one sinusoid (illustrated by the processing block 32) for each selected peak using the measured frequency, amplitude, and phase values.

In addition to the mentioned processing steps, the following procedure may be used to smooth onset and termination of the sinusoid: If the sinusoid is close in frequency to one generated for the previous segment, the amplitude, phase, and instantaneous frequency may be interpolated across the output segment duration to produce an amplitude- and frequency-modulated sinusoid. A frequency component that does not have a match from the previous segment may be weighted with a rising ramp to provide a smooth onset transition ("birth"), and a frequency component that was present in the previous segment but not in the current one may be weighted with a falling ramp to provide a smooth transition to zero amplitude ("death").

The segments may for example be windowed with a von Hann raised cosine window. One window size that can be used is 24 ms (530 samples at a sampling rate of 22.05 kHz). Other window shapes and sizes may be used.

Figure 6:
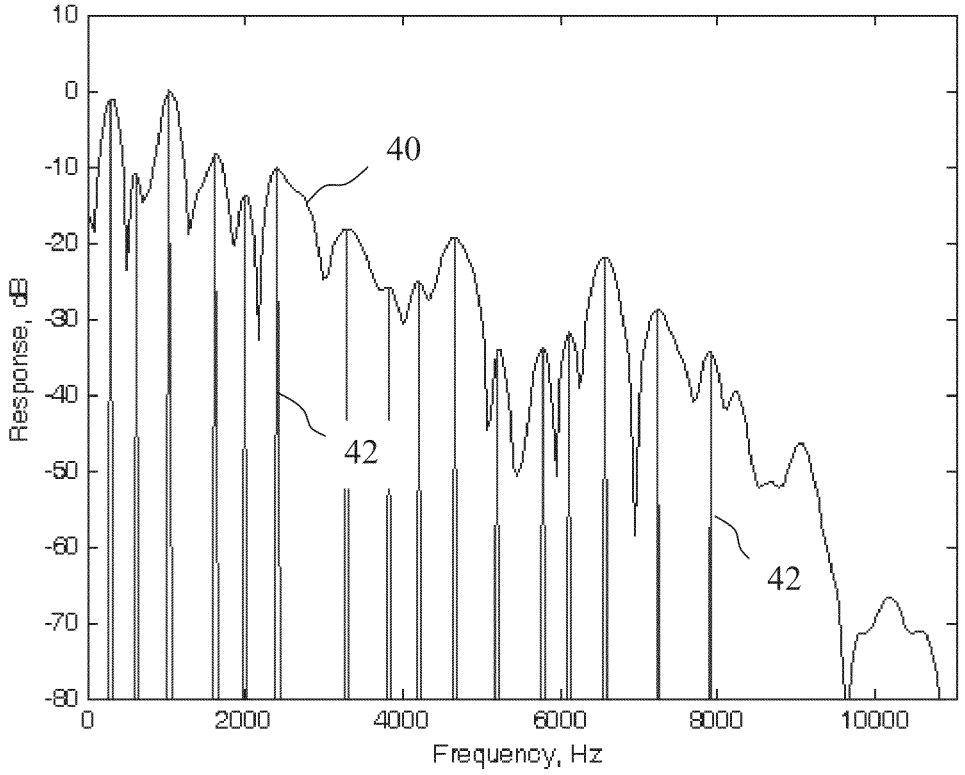

A schematic example of peak selection is illustrated in FIG. 6, wherein the magnitude spectrum of a windowed speech (male talker) segment 40 is illustrated, with the 16 highest selected peaks indicated by the vertical spikes 42 (for simplicity and to increase the intelligibility of FIG. 6, only two of the vertical spikes have been marked with the designation number 42). In this example four of the peaks of the magnitude spectrum occur below 2 kHz and the remaining 12 peaks occur at or above 2 kHz. Reproducing the entire spectrum for this example would require a total of 22 peaks. Using a shorter segment size may give poorer vowel reproduction due to the reduced frequency resolution, but it will give a more accurate reproduction of the signal time-frequency envelope behavior. Since one objective of one or more embodiments is signal reproduction and modification of frequencies, and since the human auditory system may have reduced frequency discrimination at some frequencies, the reduction in frequency resolution may not be audible while the improved accuracy in reproducing the envelope behavior may in fact lead to improved speech quality.

Figure 7:
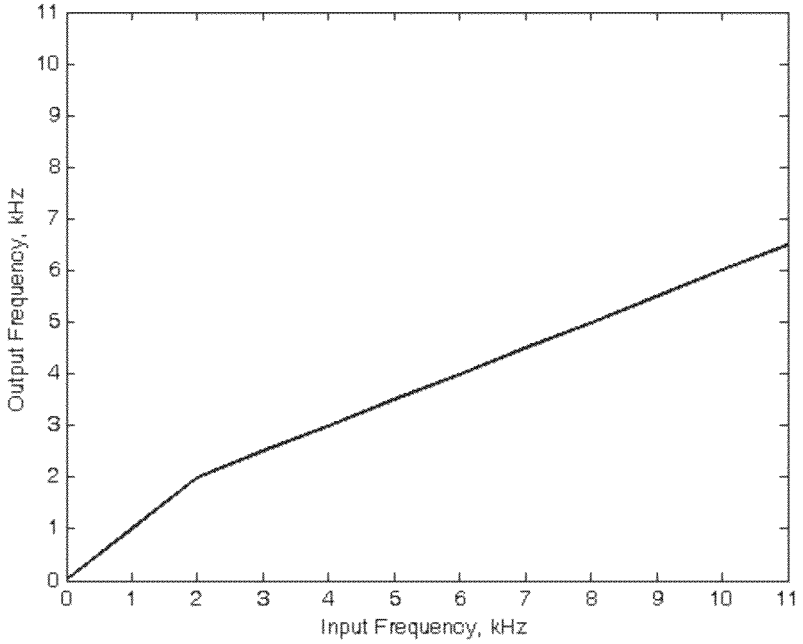

FIG. 7 illustrates an example for applying frequency lowering. Frequency lowering (e.g. according to processing block 30) may be at high frequencies, e.g. above 2 kHz. Ten sinusoids may be used to reproduce the high-frequency region. The illustrated frequency shift used is 2:1 frequency compression as shown in FIG. 7. This means that frequencies at and below 2 kHz are reproduced with no modification in the low-frequency band. Above 2 kHz, the frequency lowering causes 3 kHz to be reproduced as a sinusoid at 2.5 kHz, 4 kHz is mapped to 3 kHz, and so on up to 11 kHz, which is reproduced as a sinusoid at 6.5 kHz. Scientific investigations (as will be clear in the following) have shown that such a scheme of frequency lowering may lead to a small change in the timbre of the voices, but with little apparent distortion.

Any other frequency shifting may be possible in addition or as an alternative to the one illustrated by means of FIG. 7. For instance, frequency highering may be applied as an alternative or in addition to frequency lowering. Furthermore a non-linear shifting may be applied.

Figure 8:
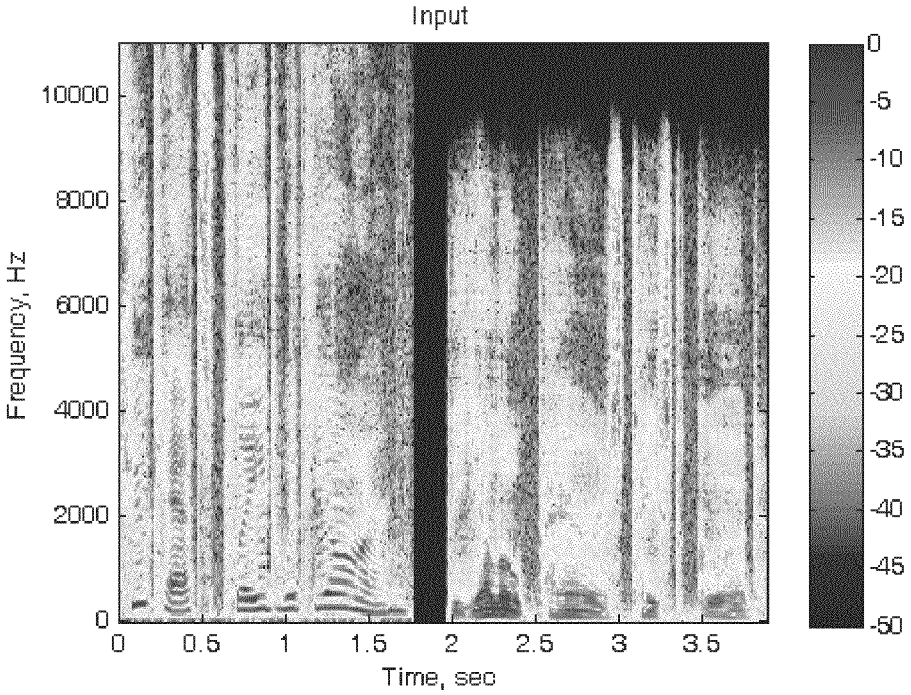

FIG. 8 schematically illustrates the spectrogram of a test signal. The signal comprises two sentences, the first spoken by a female talker and the second spoken by a male talker. The bar to the right shows the range in dB (re: signal peak level).

Figure 9:
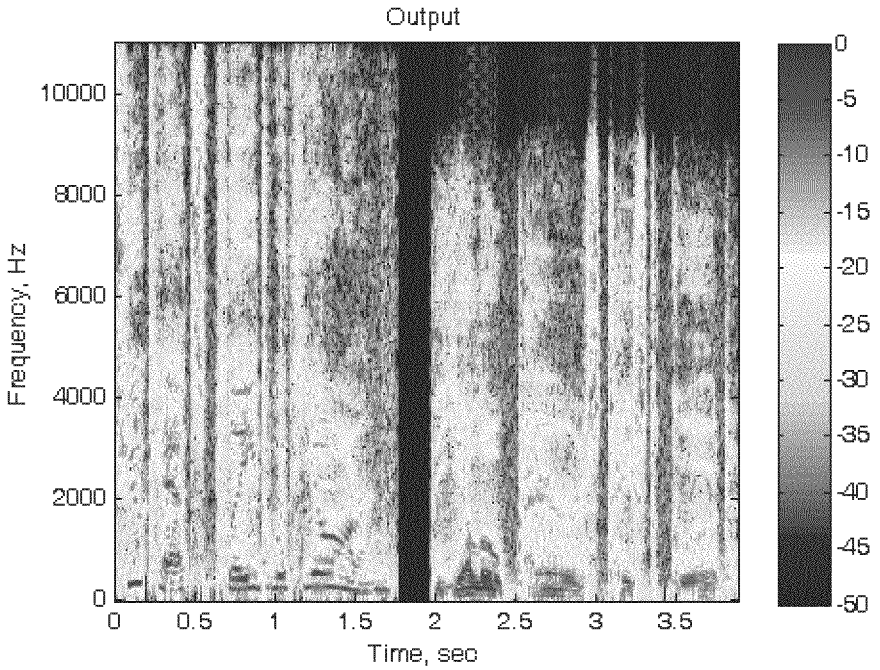

The spectrogram of the input speech is shown in FIG. 8, and the spectrogram for the sentences reproduced using sinusoidal modeling with 32 sinusoids used to reproduce the entire spectrum is shown in FIG. 9. Some loss of resolution is visible in the sinusoidal model. For example, at approximately 0.8 sec the pitch harmonics below 1 kHz appear to be blurry in FIG. 9 and the harmonics between 2 and 4 kHz are also poorly reproduced. Similar effects can be observed between 1.2 and 1.5 sec. The effects of sinusoidal modeling for the male talker, starting in FIG. 9 at about 2 sec, are much less pronounced.

Figure 10:
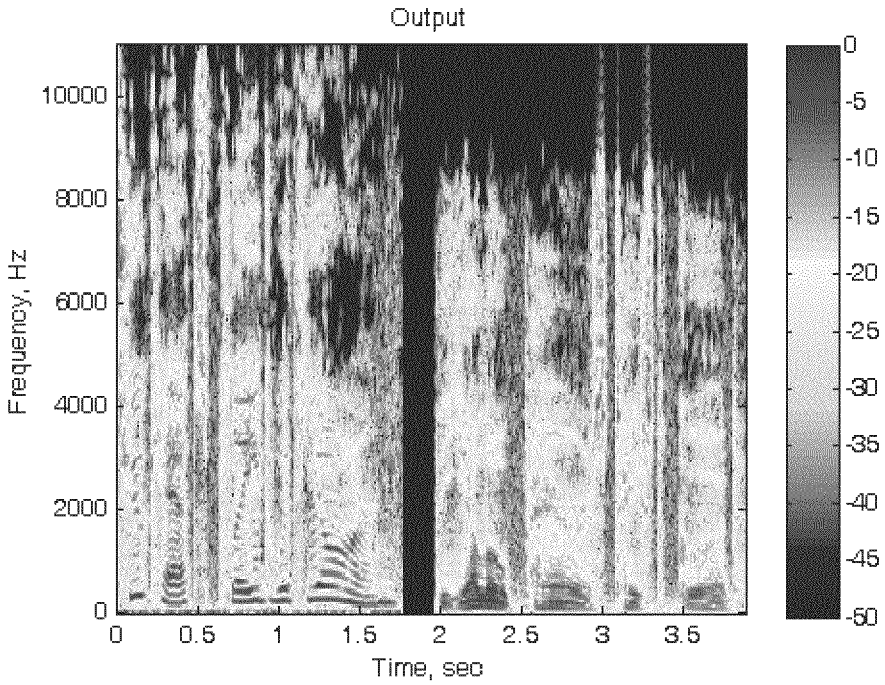
Figure 19:
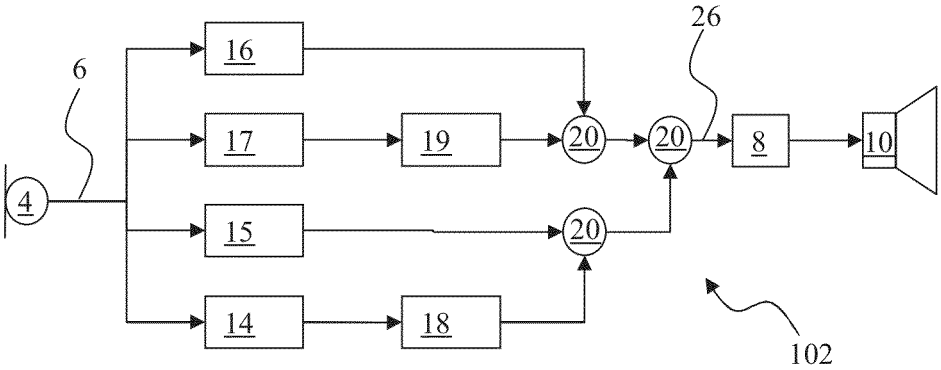
Figure 20:
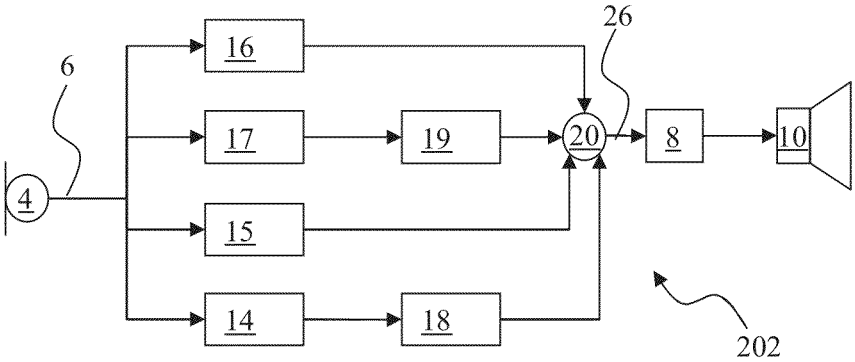

The spectrogram for a simulated processing, in a two-band hearing aid according to the embodiment of a hearing device illustrated in FIG. 19 or FIG. 20, is illustrated in FIG. 10, wherein sinusoidal modeling is used in the first synthesizing unit 18 and the second synthesizing unit 19. Ten sinusoids were used for the fourth frequency part, i.e. for frequencies above 2 kHz in the illustrated example of FIG. 10. The frequencies below 2 kHz have been reproduced slight modification caused by the first synthesizing unit 18, however, the illustrated spectrogram may appear to substantially match the original at low frequencies even though there is a slight difference. Above 2 kHz, however, imperfect signal reproduction, caused by the sinusoidal modeling, may be observed more clearly.

Figure 11:
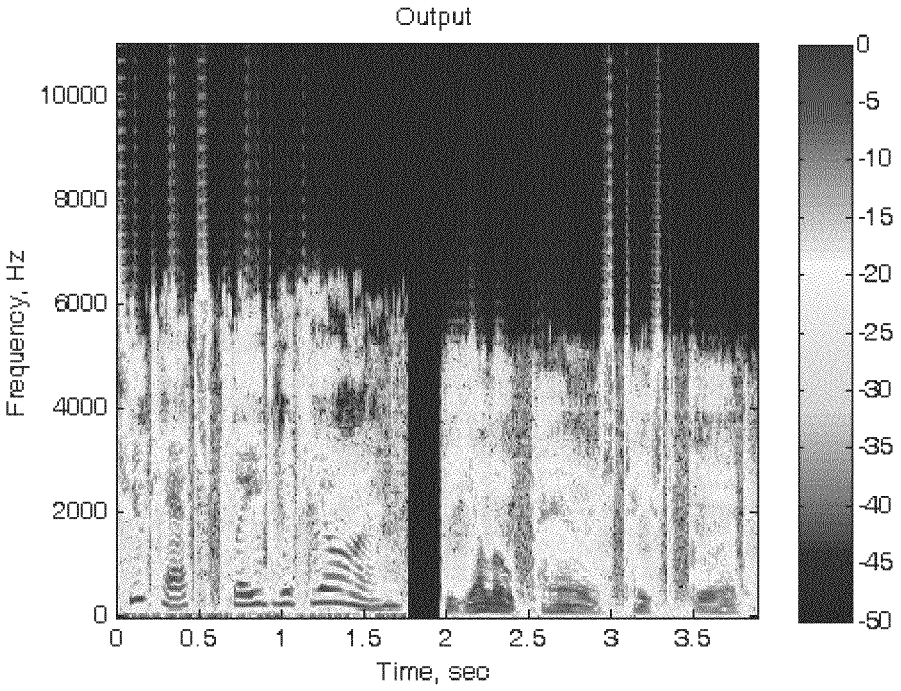

The spectrogram for a frequency compression is presented in FIG. 11. Most of the detail in the harmonic structure above 2 kHz appears to have been lost, but most of the envelope behavior has been preserved. The shift of the frequencies above 2 kHz is obvious. The FFT size used in this example was 24 ms with a windowed segment duration of 6 ms. Reducing the FFT size to match the segment size of 6 ms (132 samples) could be more practical in a hearing device according to one or more embodiments. The reduction in FFT size could give the same spectrogram and speech quality as the example presented here since the determining factor may be the segment size.

Figure 12:
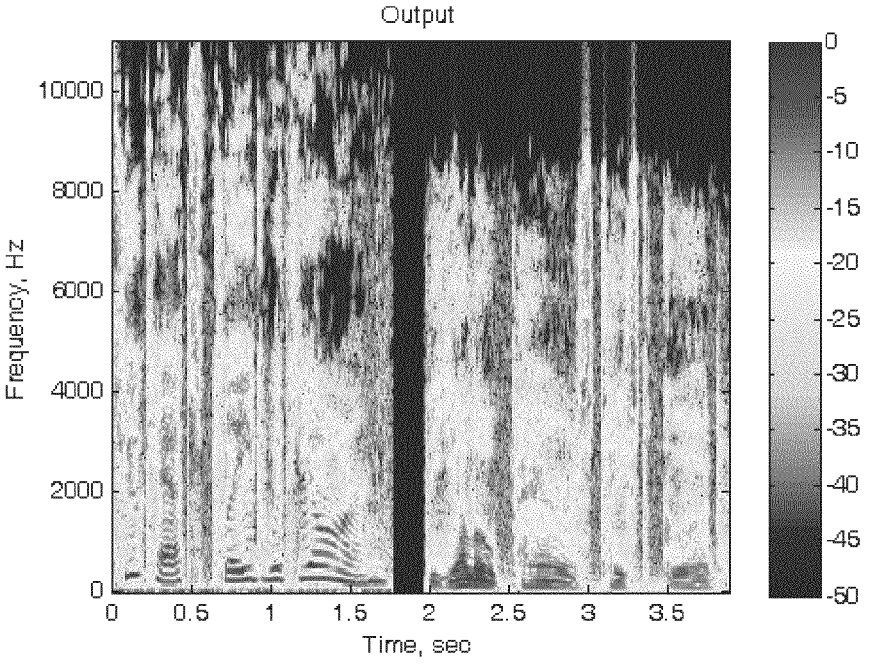

FIG. 12 schematically illustrates a spectrogram for test sentences reproduced using sinusoidal modeling with 2:1 frequency compression and random phase above 2 kHz (second frequency part). Original speech is provided below 1.2 kHz and between 1.5 and 2 kHz, and sinusoidal modeling at a frequency band from 1.2 to 1.5 kHz (first frequency part) is applied. Phase randomization is in the illustrated example implemented using a simulation of a hearing device according to one or more embodiments, with sinusoidal modeling above 2 kHz. The frequencies above 2 kHz were reproduced using ten sinusoids. The amplitude information for the sinusoids is preserved but the phase has been replaced by random values. The random phase has essentially no effect on the speech intelligibility or quality, since the $I_3$ intelligibility index (reported in Kates, J. M., and Arehart, K. H. (2005), "Coherence and the speech intelligibility index," J. Acoust. Soc. Am., Vol. 117, pp 2224-2237) for the sinusoidal modeling is 0.999 using the original phase values above 2 kHz and is also 0.999 for the random phase speech, which indicates that perfect intelligibility would be expected. Similarly, the HASQI quality index (reported in Kates, J. M. and Arehart, K. H. (2009), "The hearing aid speech quality index (HASQI)", submitted for publication J. Audio Eng. Soc.) values are 0.921 for sinusoidal modeling using the original phase values above 2 kHz and 0.915 for the random phase speech, so there is essentially no decrement in quality. Note that HASQI measures the change in the envelope of the signal that has been processed and the original signal, so the result shows that the sinusoidal modeling with random phase has not modified the speech envelope to a significant degree. Similar applies for the sinusoidal modeling at the frequency band from 1.2 to 1.5 kHz.

The spectrogram for the speech comprising random phase in the high-frequency band is presented in FIG. 12. Randomizing the phase has caused a few small differences in comparison with the sinusoidal modeling above 2 kHz shown in the spectrogram on FIG. 10. For example, between 0.6 and 0.8 sec the random phase signal shows less precise harmonic peaks between 3 and 5 kHz than the sinusoidal modeling using the original phase values.

Figure 13:
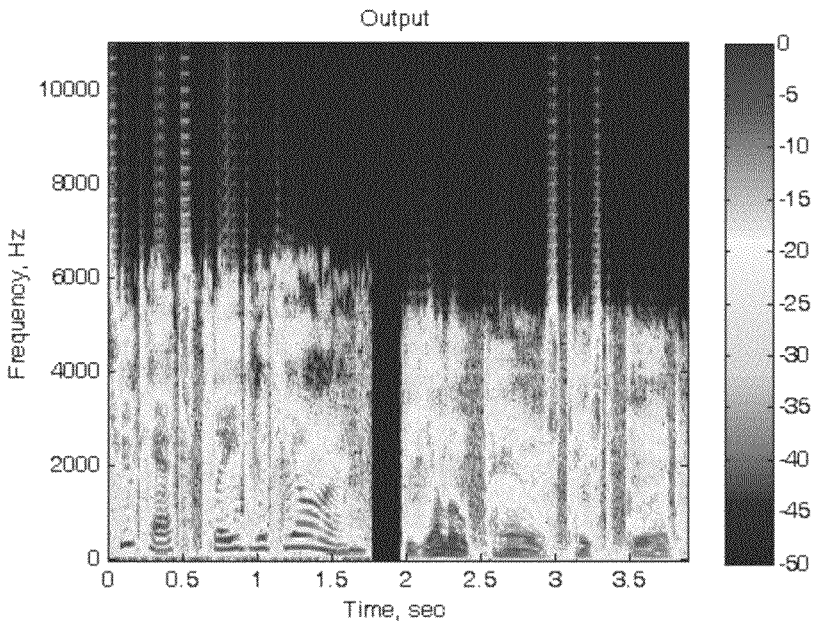

FIG. 13 illustrates the spectrogram for the test sentences reproduced using sinusoidal modeling with 2:1 frequency compression and random phase above 2 kHz (second frequency part) and original speech below 2 kHz except for a first frequency part. For the combined processing, the sinusoidal modeling of the second frequency part uses the original amplitude and random phase values, and then generates the output sinusoids at shifted frequencies. The combination of frequency lowering and phase randomization was implemented using a simulation of a hearing aid configured for sinusoidal modeling above 2 kHz. The frequencies above 2 kHz were reproduced using ten sinusoids. As can be seen from the spectrogram the audible differences between the combined processing and frequency lowering using the original phase values are quite small.

Figure 14:
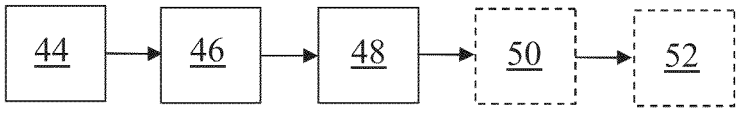
FIG. 14 schematically illustrates a flow diagram of an embodiment of a method, FIG. 15 schematically illustrates a flow diagram of an alternative embodiment of a method, FIG. 16 schematically illustrates a flow diagram of another embodiment of a method, FIG. 17 schematically illustrates a flow diagram of an yet another alternative embodiment of a method, FIG. 18 schematically illustrates a flow diagram of an embodiment of a method, and FIGS. 19-23 schematically illustrate embodiments of a hearing device.

FIG. 14 illustrates a flow diagram of a method according to some embodiments of de-correlating an input signal and output signal of a hearing device. The method comprises: selecting 44 a plurality of frequency parts of the input signal, generating 46 a first synthetic signal, and combining 48 a plurality of process signals.

The plurality of frequency parts includes a first frequency part and a second frequency part. The first frequency part comprises a low pass filtered part. The second frequency part comprises a high pass filtered part.

Generating the first synthetic signal is on the basis of the first frequency part and a first model, wherein the first model is being based on a first periodic function.

The combining of a plurality of process signals includes combining the first synthetic signal and the second frequency part.

The flow diagram of the method illustrated in FIG. 14 may be employed in a hearing aid, and the combined signal may subsequently be processed in accordance with a hearing impairment correction algorithm and may then subsequently be transformed into a sound signal by a receiver of the hearing aid. These two optional additional parts are illustrated in FIG. 14 by the dashed blocks 50 (processing of the combined signal according to a hearing impairment correction algorithm) and 52 (transformation of the hearing impairment corrected signal into a sound signal).

Figure 15:
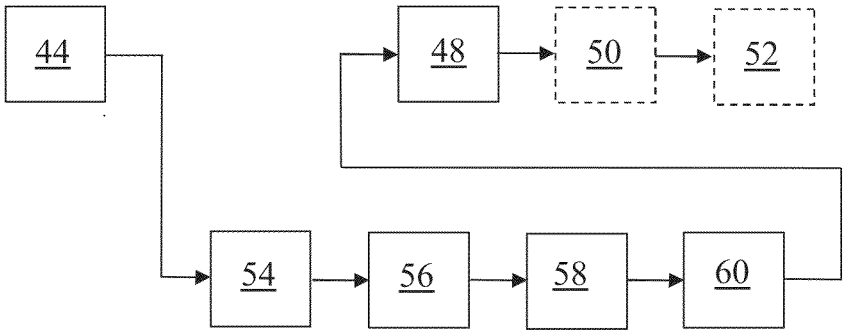

FIG. 15 illustrates a flow diagram of an alternative embodiment of a method, further comprising the step of:

- dividing the first (and/or second) frequency part of the input signal into a plurality of (possibly overlapping) segments as indicated by the block 54,
- windowing and transforming each segment into the frequency domain as indicated by the block 56. This step (56) could in one or more embodiments be achieved by using a windowed Fast Fourier Transformation (FFT), windowed by a Hanning window.
- selecting the N highest peaks in each segment as indicated by block 58, wherein N is a suitable natural number, e.g. 1, 2 or higher than 2, such as around 8-20, for example 10, and
- generating the first (and/or second) synthetic signal, as indicated by the step 60, by replacing each of the selected peaks with a periodic function. Effectively, step 46 shown in FIG. 14 is split up into the steps 54, 56, 58 and 60. As illustrated, the embodiment of the method shown in FIG. 15 may also comprise the optional additional steps 50 and 52 described above with reference to FIG. 14. In one or more embodiments of a method according to the embodiment shown in FIG. 15, the step 46 of generating the synthetic signal may further comprise the step of using the frequency, amplitude and phase of each of the N peaks to generate the periodic function.

Figure 16:
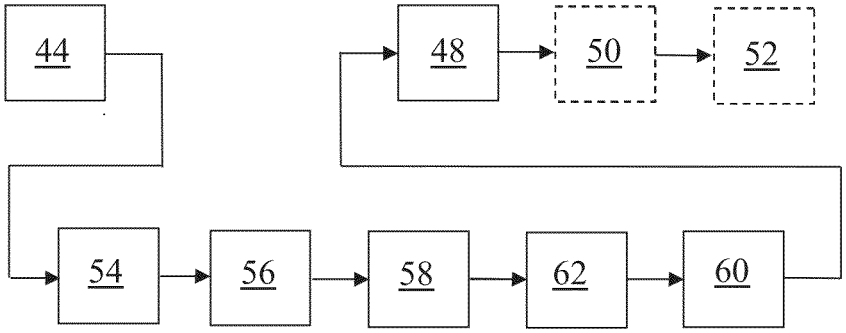

In FIG. 16 is illustrated a flow diagram of an alternative (or additional) embodiment of the method shown in FIG. 15, further comprising the step 62 of shifting the generated synthetic signal (or part(s) thereof) downward (and/or upward) in frequency by replacing each of the selected peaks with a periodic function having a lower (and/or higher) frequency than the frequency of each of the peaks.

Figure 17:
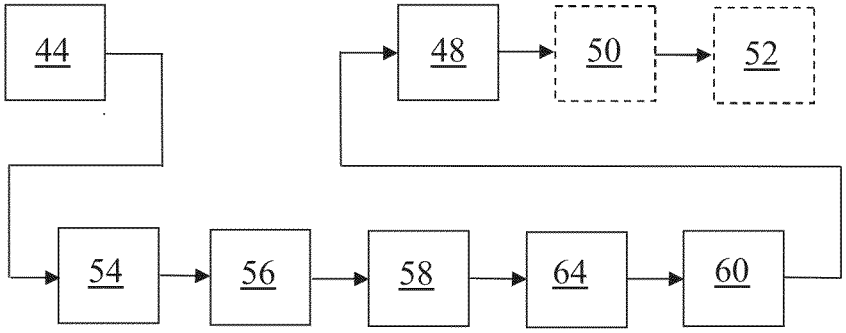

In FIG. 17 is illustrated a flow diagram of an alternative (or additional) embodiment of the method illustrated in FIG. 15, further comprising a step 64, wherein the phase of the first (and/or second) synthetic signal is at least in part randomized, by replacing at least some of the phases of some of the selected peaks with a phase randomly or pseudo randomly chosen from a uniform distribution over (0, 2π) radians.

Figure 18:
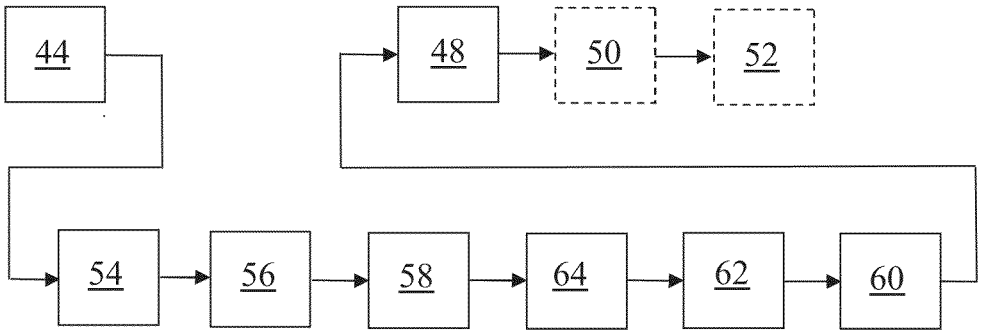

FIG. 18 illustrates yet an alternative (or additional) embodiment of the method shown in FIG. 15, wherein the frequency shifting, such as lowering, (step 62) as described above and phase randomisation (step 64) as described above is combined in the same embodiment.

According to one or more embodiments of the methods illustrated in any of the FIG. 17 or 18 the randomization of the phases may be adjustable, and according to one or more embodiments of the method illustrated in any of the FIG. 17 or 18 the randomization of the phases may be performed in dependence of the stability of a hearing aid.

Referring to FIG. 14, one or more embodiments may, in addition to that described in connection with FIG. 14, comprise shifting the generated synthetic signal downward and/or upward in frequency by replacing selected peaks (e.g. each of selected peaks) with a periodic function having a lower frequency than the frequency of each of the peaks, and/or may comprise a step, wherein the phase of the synthetic signal is at least in part randomized, by replacing at least some of the phases of some of the selected peaks with a phase randomly or pseudo randomly chosen from a uniform distribution over (0, 2π) radians.

FIG. 19 schematically illustrates hearing device 102 comprising: a first filter 14, a second filter 16, a first synthesizing unit 18, a combiner 20 (i.e. a combiner 20 that includes a plurality of combiners 20), a third filter 15, a fourth filter 17, and a second synthesizing unit 19. Furthermore, the hearing device 102 comprises an input transducer 4, a hearing loss processor 8, and a receiver 10. The input transducer is configured for provision of an input signal 6.

The first filter 14 is configured for providing a first frequency part of the input signal 6. The first frequency part comprises a low pass filtered part.

The second filter 16 is configured for providing a second frequency part of the input signal 6. The second frequency part comprises a high pass filtered part.

The first synthesizing unit 18 is configured for generating a first synthetic signal from the first frequency part using a first model based on a first periodic function.

The combiner 20 (that for the hearing device 102 is embodied by means of three combiners 20) is configured for combining the second frequency part with the first synthetic signal for provision of a combined signal 26.

The third filter 15 is configured for providing a third frequency part of the input signal. The third frequency part comprises a low pass filtered part. The hearing device is configured for including the third frequency part in the combined signal 26.

The first frequency part is a band pass filtered part.

The fourth filter 17 is configured for providing a fourth frequency part of the input signal 6. The fourth frequency part comprises a high pass filtered part.

The second synthesizing unit 19 is configured for generating a second synthetic signal from the fourth frequency part using a second model based on a second periodic function. The hearing device is configured for including the second synthetic signal in the combined signal 26.

The second frequency part is a band pass filtered part. The second frequency part represents higher frequencies than the first frequency part.

It is achieved for the embodiment 102 that the input signal is at least substantially divided into four frequency segments or parts: a high-frequency part (the fourth frequency part), a low-frequency part (the third frequency part), a high-frequency part of a mid-range (the second frequency part), and a low-frequency part of a mid-range (the first frequency part).

The first frequency part may for instance be between 1 kHz and 1.5 kHz.

The second frequency part may for instance be between 1.5 kHz and 2.5 kHz.

The third frequency part may for instance be below 1 kHz.

The fourth frequency part may for instance be above 2.5 kHz.

The hearing loss processor 8 is configured for processing the combined signal 26 for provision of a processed signal. The receiver 10 is configured for converting the processed signal into an output sound signal.

The embodiment 202 illustrated in FIG. 20 is substantially identical to the embodiment illustrated 102 in FIG. 19. The embodiment 202 of FIG. 20 differs from the embodiment 102 of FIG. 19 in that the combiner 20 is illustrated by means of a single combiner 20 for combining the relevant signals, i.e. the second frequency part, the third frequency part, the first synthetic signal, and the second synthetic signal.

Figure 21:
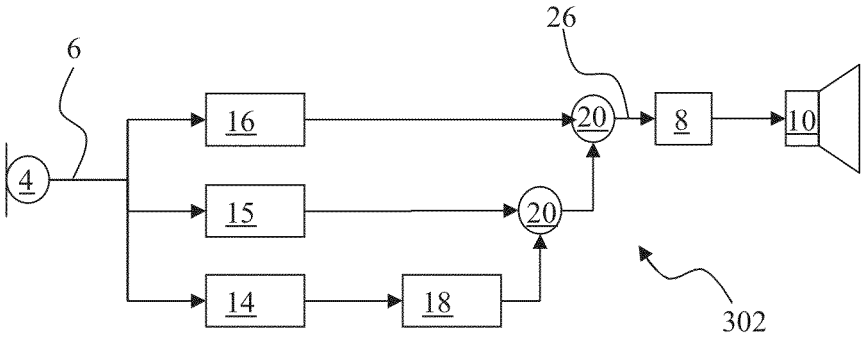
Figure 22:
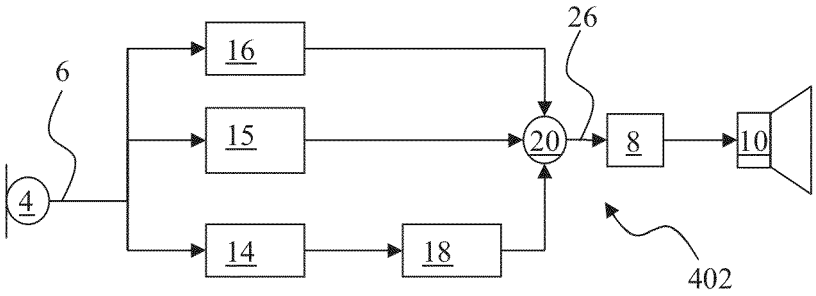

The embodiments 302 and 402 illustrated in FIGS. 21 and 22, respectively, substantially differs from the embodiments 102 and 202 in that the fourth filter and the second synthetic unit is omitted.

For the embodiments 302 and 402, it is achieved that the input signal is at least substantially divided into three frequency segments or parts: a low-frequency part (the third frequency part), a high-frequency part (the second frequency part), and a mid-range frequency part (the first frequency part).

The first frequency part may for instance be between 1 kHz and 2 kHz.

The second frequency part may for instance be above 2 kHz.

The third frequency part may for instance be below 1 kHz.

Figure 23:
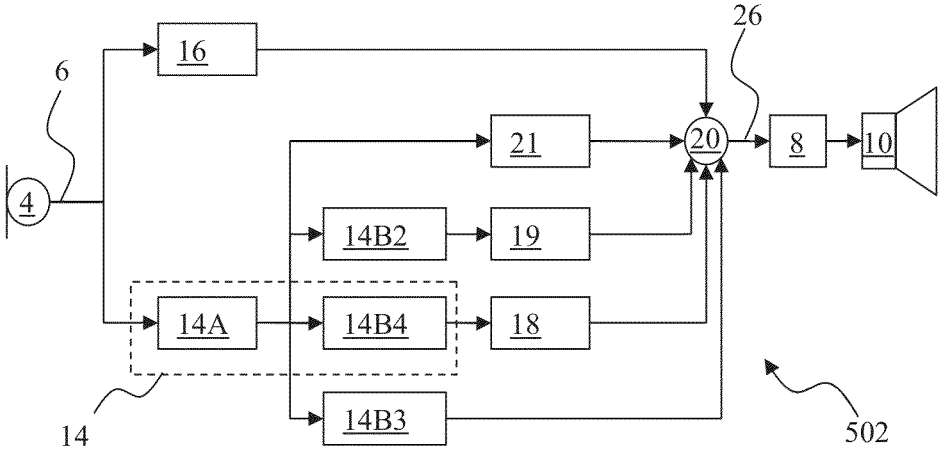

FIG. 23 schematically illustrates hearing device 502 comprising: a first filter 14 (which is comprised by two filter parts, namely 14A and 14B4), a second filter 16, a first synthesizing unit 18, a combiner 20, a third filter (which is comprised by two filter parts, namely 14A and 14B3), a fourth filter (which is comprised by two filter parts, namely 14A and 14B2), a second synthesizing unit 19, a fifth filter 14A and a third synthesizing unit 21. Furthermore, the hearing device 502 comprises an input transducer 4, a hearing loss processor 8, and a receiver 10. The input transducer is configured for provision of the input signal 6.

The first filter 14 is configured for providing a first frequency part of the input signal 6. The first frequency part comprises a low pass filtered part.

The second filter 16 is configured for providing a second frequency part of the input signal 6. The second frequency part comprises a high pass filtered part.

The first synthesizing unit 18 is configured for generating a first synthetic signal from the first frequency part using a first model based on a first periodic function.

The combiner 20 is configured for combining the second frequency part with the first synthetic signal for provision of a combined signal 26.

The third filter is configured for providing a third frequency part of the input signal. The third frequency part comprises a low pass filtered part. The hearing device (i.e. the combiner 20) is configured for including the third frequency part in the combined signal 26.

The first frequency part is a band pass filtered part.

The fourth filter is configured for providing a fourth frequency part of the input signal 6. The fourth frequency part comprises a high pass filtered part.

The second synthesizing unit 19 is configured for generating a second synthetic signal from the fourth frequency part using a second model based on a second periodic function. The hearing device (i.e. the combiner 20) is configured for including the second synthetic signal in the combined signal 26.

The second frequency part is a band pass filtered part. The second frequency part represents higher frequencies than the first frequency part.

The fifth filter 14A is configured for a providing a fifth frequency part of the input signal 6.

The third synthesizing unit 21 is configured for generating a third synthetic signal from the fifth frequency part using a third model based on a third periodic function. The hearing device (i.e. the combiner 20) is configured for including the third synthetic signal in the combined signal 26.

By the embodiment illustrated in FIG. 23 it is achieved that the input signal is at least substantially divided into five frequency segments or parts: a high-frequency part (the fourth frequency part), a low-frequency part (the fifth frequency part), a high-frequency part of a mid-range (the second frequency part), a low-frequency part of a mid-range (the third frequency part), and a mid-frequency part of a mid-range (the first frequency part).

The first frequency part may for instance be between 1.5 kHz and 2 kHz.

The second frequency part may for instance be between 2 kHz and 2.5 kHz.

The third frequency part may for instance be between 1 kHz and 1.5 kHz.

The fourth frequency part may for instance be above 2.5 kHz.

The fifth frequency part may for instance be below 1 kHz.

The hearing loss processor 8 is configured for processing the combined signal 26 for provision of a processed signal. The receiver 10 is configured for converting the processed signal into an output sound signal.

Sinusoidal modeling may be used in any embodiment of the methods illustrated in any of the FIGS. 14-18 and/or in any of the devices illustrated in any of the FIGS. 1-5 and/or 19-23. The sinusoidal modeling procedure used in one or more of the embodiments may be based on the procedure of McAulay, R. J., and Quatieri, T. F. (1986), "Speech analysis/synthesis based on a sinusoidal representation", IEEE Trans. Acoust. Speech and Signal Processing, Vol ASSP-34, pp 744-754, wherein the incoming signal is divided into, preferably, overlapping segments. Each segment is windowed and an FFT is computed for the segment. The N highest peaks of the magnitude spectrum are then selected, and the frequency, amplitude, and phase of each peak are saved in a data storage unit. The output signal is then synthesized by generating one sinusoid for each selected peak using the measured frequency, amplitude, and phase values. If the sinusoid is close in frequency to one generated for the previous segment, the amplitude, phase, and instantaneous frequency may furthermore be interpolated across the output segment duration to produce an amplitude- and frequency-modulated sinusoid. A frequency component that does not have a match from the previous segment may be weighted with a rising ramp to provide a smooth onset transition ("birth"), and a frequency component that was present in the previous segment but not in the current one may be weighted with a falling ramp to provide a smooth transition to zero amplitude ("death").

In the example wherein the periodic function is a sinusoid, it is contemplated that sinusoidal modeling (as well as modeling using a periodic function in general) also gives the option of using partially random phase. Blending the original and random phase values provides a way of continuously adjusting the amount randomization applied to the signal in response to the estimated system stability. A hearing aid 2 and/or hearing device that appears to be stable can use the original phase values, with a gradual transition to random phase when the hearing aid 2 and/or hearing device starts to go unstable. Thus, the phase randomization, such as illustrated (e.g. by processing block 34 or 64) in any of the FIG. 3, 4, 5, 17 or 18, may be adjustable. Furthermore, in one or more embodiments, the adjustment of the phase randomization, such as illustrated (e.g. by processing block 34 or 64) in any of the FIG. 3, 4, 5, 17 or 18, may be performed in dependence of the stability of the hearing aid 2 and/or the hearing device.

Accordingly, it is seen that the new idea presented in the present specification pertaining to providing a plurality of frequency parts of the input signal, and then applying for example sinusoidal modeling only at one or more frequency parts is feasible and advantageous in hearing devices such as hearing aids. The processing results presented herein indicate that sinusoidal modeling is an effective procedure for frequency shifting and/or signal de-correlation. Additionally, sinusoidal modeling has several advantages: It may be used to accurately reproduce speech without the need for pitch detection or voiced/unvoiced decisions; neither of these operations was implemented in the examples presented here. Limiting the frequency parts to for generation of synthetic signal(s) to a limited range, such as to high frequencies and/or other frequency ranges such as low frequencies and/or a band-pass range may be effective in removing at least some audible processing artifacts. Furthermore the reduced number of sinusoids needed for a limited frequency reproduction may greatly reduce the computational load associated with the processing thereof. The result may be nonlinear signal manipulations that are computationally efficient yet still give high speech quality. The examples presented in this the present specification have the purpose to illustrate the feasibility of sinusoidal modeling and are not meant to be final and/or limited versions of processing to be programmed into a hearing aid and/or hearing device.

As will be understood by those familiar in the art, the embodiments described herein may be embodied in other specific forms than those described above and illustrated in the drawings and may utilize any of a variety of different algorithms without departing from the spirit or essential characteristics thereof. For example, the selection of an algorithm (for example what kind of sinusoidal modelling is to be used) is typically application specific, the selection depending upon a variety of factors including the expected processing complexity and computational load. Accordingly, the disclosures and descriptions herein are intended to be illustrative, but not limiting, of the scope of the claimed invention.

Particular aspects are described in the following items.

Items

1. A hearing device comprising:

a first filter configured for providing a first frequency part of an input signal of the hearing device, the first frequency part comprising a low pass filtered part, a second filter configured for providing a second frequency part of the input signal, the second frequency part comprising a high pass filtered part, a first synthesizing unit configured for generating a first synthetic signal from the first frequency part using a first model based on a first periodic function, and a combiner configured for combining the second frequency part with the first synthetic signal for provision of a combined signal.

2. A hearing device according to item 1, wherein the hearing device comprises a third filter configured for providing a third frequency part of the input signal, the third frequency part comprising a low pass filtered part, and the hearing device is configured for including the third frequency part in the combined signal.

3. A hearing device according to item 1 or 2, wherein the first frequency part is a band pass filtered part.

4. A hearing device according to any of the preceding items, wherein the hearing device comprises a fourth filter configured for providing a fourth frequency part of the input signal, the fourth frequency part comprising a high pass filtered part, the hearing device comprises a second synthesizing unit configured for generating a second synthetic signal from the fourth frequency part using a second model based on a second periodic function, the hearing device is configured for including the second synthetic signal in the combined signal, and the second frequency part is a band pass filtered part.

5. A hearing device according to item 4, wherein the second synthesizing unit is configured for shifting the frequency of the second synthetic signal downward in frequency.

6. A hearing device according to any of the preceding items, wherein the first synthesizing unit is configured for shifting the frequency of the first synthetic signal.

7. A hearing device according to any of the preceding items, wherein the first synthesizing unit is configured for dividing the first frequency part into a first plurality of segments, which segments may be overlapping, windowing and transforming each segment of the first plurality of segments into the frequency domain, and selecting the N highest peaks in each segment, where N may be at least 2, wherein generating the first synthetic signal includes replacing each of the selected peaks with the first periodic function.

8. A hearing device according to any of the preceding items, wherein the hearing device comprises:

an input transducer configured for provision of the input signal, and/or a hearing loss processor configured for processing the combined signal for provision of a processed signal, the processing being in accordance with a hearing loss of a user of the hearing device, and/or a receiver configured for converting the processed signal into an output sound signal.

9. A hearing device according to any of the preceding items, wherein the first periodic function includes a trigonometric function, such as a sinusoid or a linear combination of sinusoids.

10. A hearing device according to any of the preceding items, wherein the phase of the first synthetic signal at least in part is randomized.

11. A hearing device according to item 10, wherein the randomization of the phase is adjustable.

12. A hearing device according to any of the preceding items as dependent on item 6, wherein the first synthesizing unit is configured for shifting the frequency of at least a first part of the first synthetic signal downward in frequency.

13. A hearing device according to any of the preceding items as dependent on item 6, wherein the first synthesizing unit is configured for shifting the frequency of at least a second part of the first synthetic signal upward in frequency.

14. A hearing device according to any of the preceding items as dependent on item 4, wherein the phase of the second synthetic signal at least in part is randomized.

15. A hearing device according to any of the preceding items as dependent on items 7 and 10, wherein the phase of the first synthetic signal is at least in part randomized by replacing at least some of the phases of some of the selected peaks with a phase randomly or pseudo randomly chosen from a uniform distribution over $(0, 2\pi)$ radians.

16. A hearing device according to any of the preceding items as dependent on item 10, wherein the randomization of the phase(s) is performed in dependence of the stability of the hearing device.

17. A hearing device according to any of the preceding items as dependent on items 7, wherein generating the first synthetic signal comprises using the frequency, amplitude and phase of each of the N peaks.

18. A hearing device according to any of the preceding items, wherein the hearing device is any one or any combination of the following: hearing instrument and hearing aid.

19. A method of de-correlating an input signal and output signal of a hearing device, the method comprising:

selecting a plurality of frequency parts of the input signal, the plurality of frequency parts including a first frequency part and a second frequency part, the first frequency part comprising a low pass filtered part, the second frequency part comprising a high pass filtered part, generating a first synthetic signal on the basis of the first frequency part and a first model, the first model being based on a first periodic function, and combining a plurality of process signals including the first synthetic signal and the second frequency part.

20. A method according to item 19, wherein the plurality of frequency parts includes a third frequency part comprising a low pass filtered part, and the plurality of process signals includes the third frequency part.

21. A method according to item 19 or 20, wherein the first frequency part is a band pass filtered part.

22. A method according to any of the items 19-21, wherein the plurality of frequency parts includes a fourth frequency part comprising a high pass filtered part, the method comprising generating a second synthetic signal on the basis of the fourth frequency part and a second model, the second model being based on a second periodic function, the plurality of process signals includes the second synthetic signal, and the second frequency part is a band pass filtered part.

23. A method according to any of the items 19-22, the method comprising dividing the first frequency part into a first plurality of segments, which segments may be overlapping, windowing and transforming each segment of the first plurality of segments into the frequency domain, and selecting the N highest peaks in each segment, where N is at least 2, wherein generating the first synthetic signal includes replacing each of the selected peaks with the first periodic function.

24. A method according to item 23, wherein at least a first part of the generated first synthetic signal is shifted downward in frequency by replacing at least a first part of the selected peaks with a periodic function having a lower frequency than the frequency of the at least first part of the selected peaks.

25. A method according to item 23 or 24, wherein at least a second part of the generated first synthetic signal is shifted upward in frequency by replacing at least a second part of the selected peaks with a periodic function having a higher frequency than the frequency of the at least second part of the selected peaks.

26. A method according to any of the items 23-25, wherein the phase of the first synthetic signal is at least in part randomized by replacing at least some of the phases of some of the selected peaks with a phase randomly or pseudo randomly chosen from a uniform distribution over $(0, 2\pi)$ radians.

27. A method according to any of the items 19-26, wherein the periodic function includes a trigonometric function, such as a sinusoid or a linear combination of sinusoids.

28. A method according to any of the items 19-27, wherein the phase of the first synthetic signal at least in part is randomized.

29. A method according to item 28, wherein the randomization of the phase is adjustable.

30. A method according to any of the items 19-29 as dependent on item 22, wherein the phase of the second synthetic signal at least in part is randomized.

31. A method according to any of the items 19-30 as dependent on item 28, wherein the randomization of the phase(s) is performed in dependence of the stability of the hearing device.

32. A method according to any of the items 19-31 as dependent on item 23, wherein generating the first synthetic signal comprises using the frequency, amplitude and phase of each of the N peaks.

33. A method according to any of the items 19-32, wherein the hearing device is any one or any combination of the following: hearing instrument and hearing aid.

The invention claimed is:

1. A hearing device comprising:

a first filter configured for providing a first frequency part of an input signal of the hearing device, the first frequency part comprising a low pass filtered part;

a second filter configured for providing a second frequency part of the input signal, the second frequency part comprising a high pass filtered part;

a first synthesizing unit configured for generating a first synthetic signal from the first frequency part using a first model based on a first periodic function; and a combiner configured for combining the second frequency part with the first synthetic signal for provision of a combined signal.

2. The hearing device according to claim 1, wherein the first frequency part is a band pass filtered part.

3. The hearing device according to claim 1, further comprising a third filter configured for providing a third frequency part of the input signal, the third frequency part comprising another low pass filtered part;

wherein the combiner is configured for including the third frequency part in the combined signal.

4. The hearing device according to claim 3, further comprising:

a fourth filter configured for providing a fourth frequency part of the input signal, the fourth frequency part comprising another high pass filtered part; and a second synthesizing unit configured for generating a second synthetic signal from the fourth frequency part using a second model based on a second periodic function;

wherein the combiner is configured for including the second synthetic signal in the combined signal; and wherein the second frequency part is a band pass filtered part.

5. The hearing device according to claim 4, wherein the second synthesizing unit is configured for shifting a frequency of the second synthetic signal downward.

6. The hearing device according to claim 1, wherein the first synthesizing unit is configured for shifting a frequency of the first synthetic signal.

7. The hearing device according to claim 1, wherein the first synthesizing unit is configured for:

dividing the first frequency part into a first plurality of segments;

windowing and transforming each of the first plurality of segments into a frequency domain; and selecting N peak(s) in each of the segments;

wherein the first synthesizing unit is configured to generate the first synthetic signal by replacing each of the selected peak(s) with the first periodic function.

8. The hearing device of claim 7, wherein at least two of the segments overlap.

9. The hearing device of claim 7, where N is at least 2.

10. The hearing device of claim 7, wherein the selected N peak(s) is the highest peak(s).

11. A method of de-correlating an input signal and an output signal of a hearing device, the method comprising:

selecting a plurality of frequency parts of the input signal, the plurality of frequency parts including a first frequency part and a second frequency part, the first frequency part comprising a low pass filtered part, the second frequency part comprising a high pass filtered part;

generating a first synthetic signal based on the first frequency part and a first model, the first model being based on a first periodic function; and combining a plurality of process signals, the plurality of process signals including the first synthetic signal and the second frequency part.

12. The method according to claim 11, wherein the plurality of frequency parts includes a third frequency part comprising another low pass filtered part, and the plurality of process signals includes the third frequency part.

13. The method according to claim 11, wherein the first frequency part is a band pass filtered part.

14. The method according to claim 11, wherein:

the plurality of frequency parts includes a fourth frequency part comprising another high pass filtered part;

the method further comprises generating a second synthetic signal based on the fourth frequency part and a second model, the second model being based on a second periodic function;

the plurality of process signals further includes the second synthetic signal; and the second frequency part is a band pass filtered part.

15. The method according to claim 11, further comprising:

dividing the first frequency part into a first plurality of segments;

windowing and transforming each of the first plurality of segments into a frequency domain; and selecting N peak(s) in each of the segments;

wherein the act of generating the first synthetic signal includes replacing each of the selected peak(s) with the first periodic function.

16. The method according to claim 15, wherein at least a first part of the generated first synthetic signal is shifted downward in frequency by replacing at least a first part of the selected peak(s) with a periodic function having a lower frequency than a frequency of the first part of the selected peak(s).

17. The method according to claim 16, wherein at least a second part of the generated first synthetic signal is shifted upward in frequency by replacing at least a second part of the selected peak(s) with a periodic function having a higher frequency than a frequency of the second part of the selected peak(s).

18. The method according to claim 15, wherein at least a first part of the generated first synthetic signal is shifted upward in frequency by replacing at least a first part of the selected peak(s) with a periodic function having a higher frequency than a frequency of the first part of the selected peak(s).

19. The method according to claim 15, wherein a phase of the first synthetic signal is at least in part randomized.

20. The method of claim 19, wherein the phase of the first synthetic signal is at least in part randomized by replacing a phase of at least one of the selected peak(s) with a phase randomly or pseudo randomly chosen from a uniform distribution over $(0, 2\pi)$ radians.

21. The method according to claim 15, wherein at least two of the segments overlap.

22. The method according to claim 15, where N is at least 2.

23. The method according to claim 15, wherein the selected N peak(s) is the highest peak(s).

* * * * *